US005926924A

United States Patent [19]

Tsai

[11] Patent Number: 5,926,924

[45] Date of Patent: Jul. 27, 1999

[54] HANDLE SHEATH FOR A PAPER BAG HANDLE

[76] Inventor: Dao-Long Tsai, 3F, No. 14, Alley 8, Lane 45, Pao Hsing Rd., Hsin Tien City Taipei, Taiwan

[21] Appl. No.: 09/008,299

[22] Filed: Jan. 16, 1998

[51] Int. Cl.[6] ..... A44B 21/00; B65D 25/28; A43C 9/00

[52] U.S. Cl. ..... 24/265 R; 294/158; 294/170; 16/125; 383/21; 24/298; 24/713.1

[58] Field of Search ..... 24/265 R, 703.1, 24/703.3, 703.5, 703.6, 713.1, 298; 383/12, 13, 21, 25; 294/158, 170; 229/117.19, 117.24; 16/114 B, 125

[56] References Cited

U.S. PATENT DOCUMENTS

| | | | |
|---|---|---|---|
| 574,686 | 1/1897 | Nichols | 24/713.1 |
| 1,575,022 | 3/1926 | Wakimoto | 24/713.1 |
| 2,992,768 | 7/1961 | Gatward | 383/21 |
| 3,000,067 | 9/1961 | Hanflig | 24/298 |
| 3,636,594 | 1/1972 | Faivre | 24/298 |
| 4,176,423 | 12/1979 | Wigemark | 16/125 |
| 4,691,369 | 9/1987 | Costa | 383/20 X |

*Primary Examiner*—James R. Brittain
*Assistant Examiner*—Robert J. Sandy
*Attorney, Agent, or Firm*—Rosenberg, Klein & Bilker

[57] ABSTRACT

A handle sheath fastened to one end of a twisted handle and adapted to secure it in a face panel of a paper bag, having a cylindrical body mounted around the twisted handle, a longitudinal opening, two longitudinal rows of downward teeth arranged along two longitudinal side edges at two opposite sides of the longitudinal opening and engaged into the twisted handle, a serrated axial front projection longitudinally extended from one end thereof and stopped against the face panel of the paper bag.

2 Claims, 4 Drawing Sheets

HANDLE SHEATH FOR A PAPER BAG HANDLE

BACKGROUND OF THE INVENTION

The present invention relates to a handle sheath for a paper bag handle, and more particularly to such a handle sheath which can be conveniently fastened to one end a twisted handle to secure it to a hole on a face panel of a paper bag.

A regular paper bag 1, as shown in FIG. 1, is generally equipped with two twisted handles 2. When the ends of the twisted handles 2 are respectively inserted through respective through holes 3 on the two opposite face panels of the paper bag, the ends of the twisted handles 2 are tied in knots 4. Tying the ends of the twisted handles 2 in knots 4 consumes much labor and time. In order to tie knots in the twisted handles, the twisted handles must be made relatively longer. Further, the knots 4 generally are not aesthetically pleasing.

SUMMARY OF THE INVENTION

The present invention provides a handle sheath for a twisted handle for paper bag which eliminates the aforesaid drawbacks. It is one object of the present invention to provide a handle sheath for a twisted handle for paper bag which makes the end of the twisted handle beautiful when securing it to a hole on a face panel of a paper bag. It is another object of the present invention to provide a handle sheath for a twisted handle for paper bag which enables the twisted handle to be quickly installed in a paper bag with less labor consumption. According to the present invention, the handle sheath comprises a cylindrical body mounted around the twisted handle, a longitudinal opening, two longitudinal rows of downward teeth arranged along two longitudinal side edges at two opposite sides of the longitudinal opening and engaged into the twisted handle, a serrated axial front projection longitudinally extended from one end thereof and stopped against the face panel of the paper bag.

DETAILED DESCRIPTION OF THE PREFERRED EMBODIMENT

Figure 1:
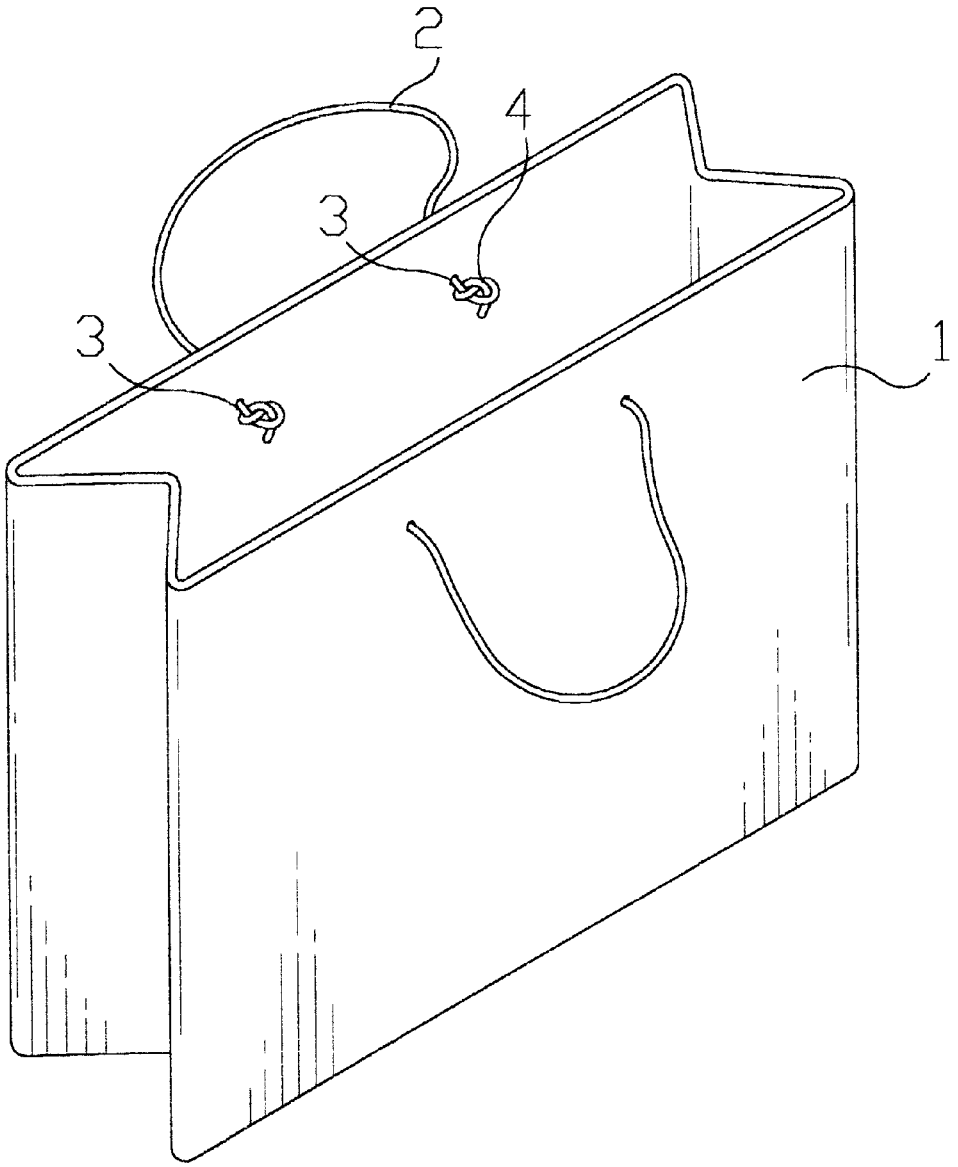
(PRIOR ART) FIG.1
FIG. 1 is an elevational view of a paper bag with twisted handles according to the prior art.
Figure 2:
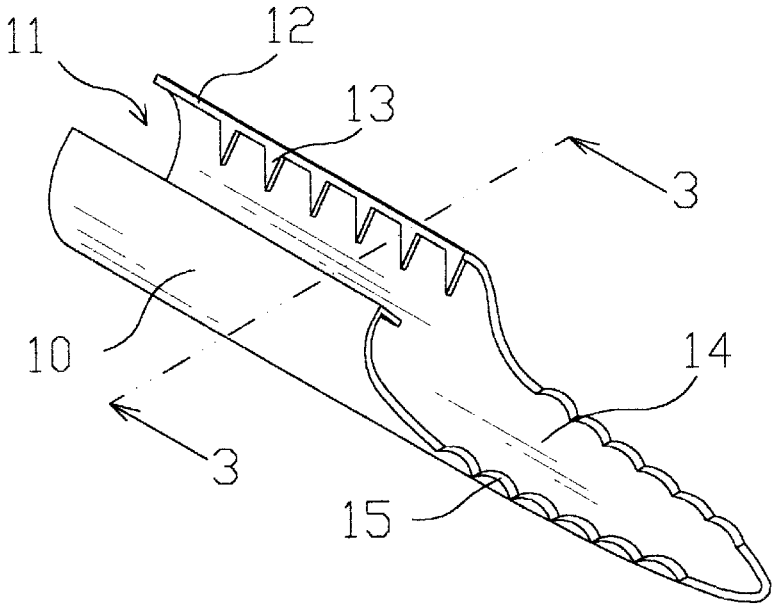
FIG. 2 is a perspective view of a handle sheath for a paper bag handle according to the present invention.
Figure 3:
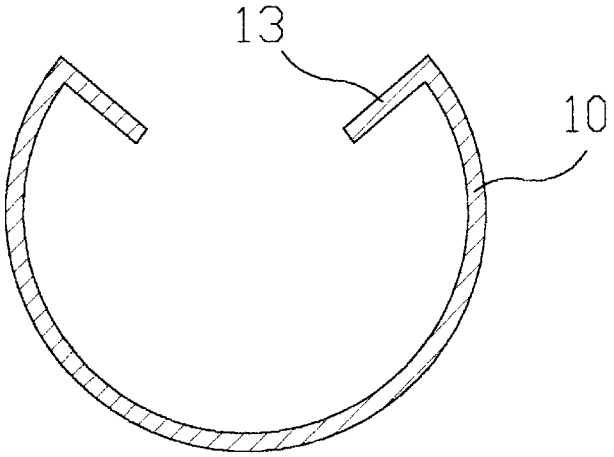
FIG. 3 is a sectional view taken along line 3—3.

Referring to FIGS. 2 and 3, a split sheath 10 is shown having a cylindrical shape, a longitudinal opening 11, two longitudinal rows of downward teeth 13 arranged along two longitudinal side edges 12 at two opposite sides of the longitudinal opening 11, an axial front projection 14 longitudinally extended from its one end, and a serrated edge 15 disposed along the border of the front projection 14.

Figure 4:
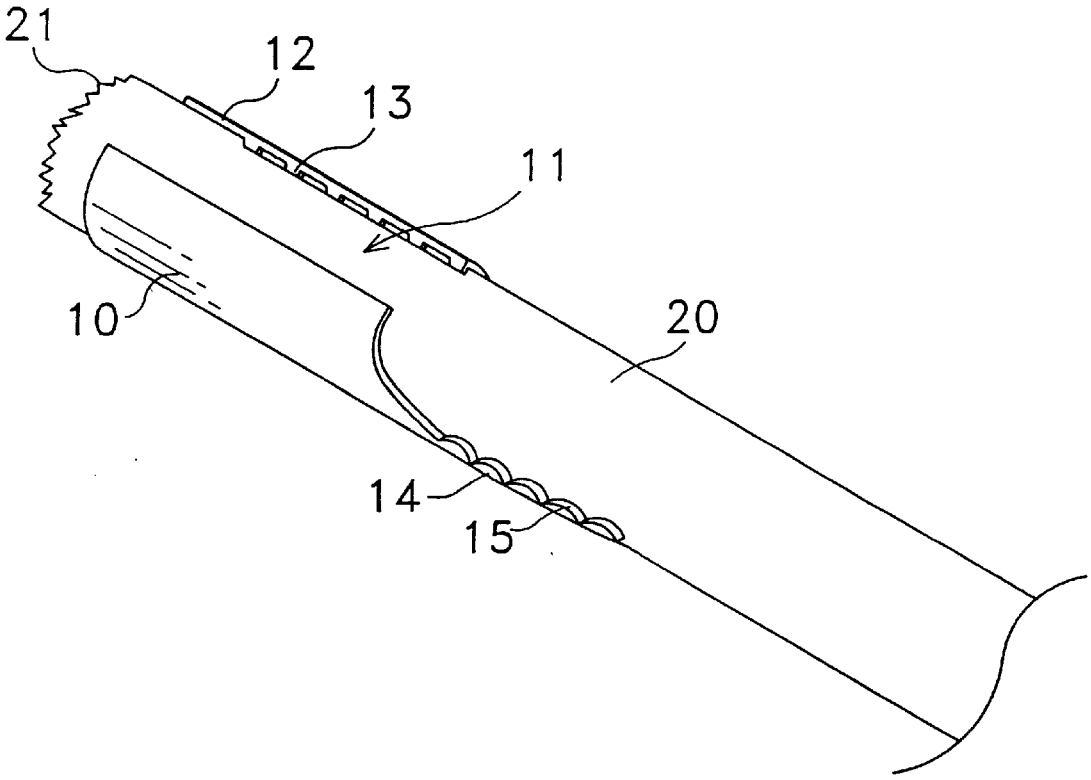
FIG. 4 shows the handle sheath fastened to a twisted handle according to the present invention.

Referring to FIG. 4, the split sheath 10 is covered on a twisted handle 20 near its one end 21, and secured thereto by engaging the downward teeth 13 into the twisted handle 20, permitting the axial front projection 14 to extend axially along the twisted handle 20 in direction reversed to the end 21 of the twisted handle 20.

Figure 5:
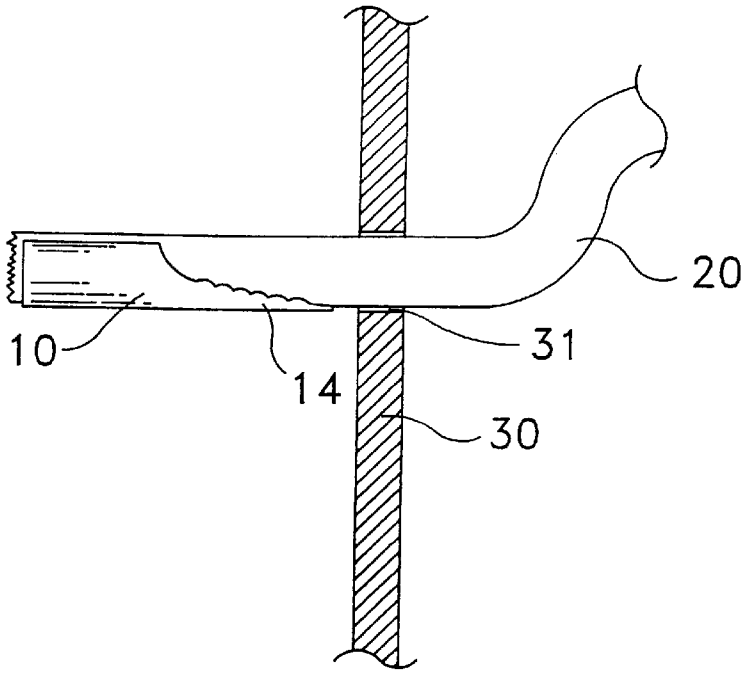
FIG. 5 shows the handle sheath and the twisted handle inserted through a hole on one face panel of a paper bag according to the present invention.
Figure 6:
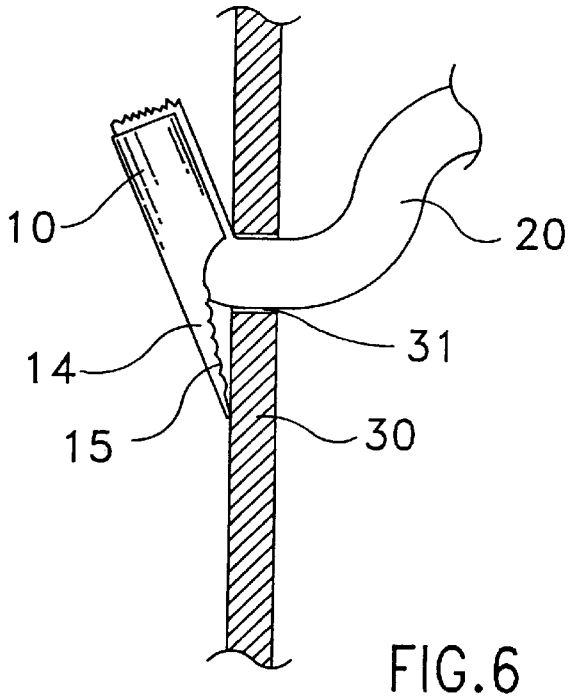
FIG. 6 shows the twisted handle lifted, the axial front extension of the handle sheath stopped against the face panel of the paper bag.

Referring to FIGS. 5 and 6, the split sheath 10 and the end 21 of the twisted handle 20 is inserted through a hole 31 on one face panel of a paper bag 30, then the twisted handle 20 is pulled back, permitting the axial front projection 14 to be stopped against the face panel of the paper bag 30 at one side. When installed, the serrated edge 15 of the axial front projection 14 is forced into engagement with the face panel of the paper bag 30.

While only one embodiment of the present invention has been shown and described, it will be understood that various modifications and changes could be made thereunto without departing from the spirit and scope of the invention disclosed. For example, hooked portions may be provided inside the split sheath between the two longitudinal side edges and engaged into the body of the twisted handle.

What the invention claimed is:

1. A handle sheath fastened to one end of a twisted handle and adapted to secure it in a face panel of a paper bag, comprising:

a cylindrical body adapted for mounting around said twisted handle, said cylindrical body having a longitudinal opening and two longitudinal rows of downward teeth arranged along two longitudinal edges at two opposite sides of said longitudinal opening for engaging said twisted handle; and, an axial front projection longitudinally extended from one end of said cylindrical body, said axial front projection having a serrated edge formed peripherally thereon for forced engagement with the face panel of said paper bag.

2. A handle sheath for coupling a flexible handle to a face panel of a bag comprising:

(a) a longitudinally extended cylindrical body portion adapted for coaxial coupling adjacent an end of the flexible handle, said cylindrical body portion having a pair of longitudinal side edges defining a longitudinally extended slot formed therein, said longitudinal side edges having a plurality of teeth extending therefrom for gripping engagement of said flexible handle; and, (b) a front projection portion extending longitudinally from said cylindrical body portion, said front projection portion having a serrated engagement edge defined peripherally thereon for anchoring engagement of the face panel of the bag.

* * * * *